US007433270B2

(12) United States Patent
Chen

(10) Patent No.: US 7,433,270 B2
(45) Date of Patent: Oct. 7, 2008

(54) ADJUSTABLE GLOBAL TIMEPIECE

(76) Inventor: Liming Chen, No. 10-36-102, Shuyuan Village, Hangzhou City, Zhejiang Province, Shenzhen (CN) 310009

( * ) Notice: Subject to any disclaimer, the term of this patent is extended or adjusted under 35 U.S.C. 154(b) by 0 days.

(21) Appl. No.: 11/375,311

(22) Filed: Mar. 14, 2006

(65) Prior Publication Data

US 2007/0008822 A1 Jan. 11, 2007

(30) Foreign Application Priority Data

Jul. 11, 2005 (CN) ..... PCT/CN2005/001013

(51) Int. Cl.
*G04B 19/22* (2006.01)

(52) U.S. Cl. ..... 368/21

(58) Field of Classification Search ..... 368/21, 368/22, 26, 27

See application file for complete search history.

(56) References Cited

U.S. PATENT DOCUMENTS 2,305,508 A * 12/1942 Woodruff ..... 368/21
4,847,819 A * 7/1989 Hong ..... 368/21
5,323,363 A * 6/1994 Hysek et al. ..... 368/21
5,524,102 A * 6/1996 Liao et al. ..... 368/21

* cited by examiner

*Primary Examiner*—Edwin A. Leon
*Assistant Examiner*—Thanh S Phan

(57) ABSTRACT

An adjustable global timepiece includes a minute pointer, a hour pointer, a movement mechanism, an inner time dial, a time zone dial, and an outer time dial. The movement mechanism has a shaft. The inner time dial has 12 or 24 blocks configured for displaying a first time in a first time zone. The inner dial is coupled to the shaft so as to be driven by the movement mechanism. The time zone dial has 12 or 24 blocks. The time zone dial is manually adjustably rotatable relative to the shaft. The outer time dial has 12 or 24 blocks configured for displaying a second time in a second time zone. The outer time dial has a time zone pointer located at the location of 12 or 24 o'clock thereof configured for indicating the second time zone. The outer time dial is manually adjustably rotatable relative to the shaft.

15 Claims, 4 Drawing Sheets

ADJUSTABLE GLOBAL TIMEPIECE

BACKGROUND OF THE INVENTION

1. Field of the Invention

The present invention relates to timepieces, and particularly to an adjustable global timepiece.

2. Description of Prior Art

A traditional timepiece generally includes a case, a dial, a movement mechanism, and time pointers, i.e. a hour hand, a minute hand and a second hand. Such timepiece can only display the time in a local time zone and cannot instantly display the time in another time zone. However, for those people frequently traveling around the world, it becomes more and more important to understand and master the local time in different time zones. Under this kind of demand, the common timepiece will not be able to provide this kind of information. Gradually, various kinds of global timepiece have been developed to improve this inconvenient situation, which can show the local time all over the world through the reading of a single timepiece.

China patent application serial No. 03215040.7 discloses a global timepiece. The global timepiece includes a dial assembly, a movement mechanism, and a date memory. The dial assembly includes a time dial and a time zone dial. The movement mechanism has a main shaft. The main shaft extends through the time dial and engages with the time zone dial so as to drive the time zone to rotate. However, the global timepiece is unduly complex, compared with a traditional timepiece. It is difficult for a user to directly understand and master the time through a glance.

SUMMARY OF THE INVENTION

Accordingly, an object of the present invention is to provide an adjustable global timepiece, which has a simple structure, and is easy and convenient for operation.

In order to achieve the above-mentioned object, an adjustable global timepiece is provided. The adjustable global timepiece includes a minute pointer, a hour pointer, a movement mechanism, an inner time dial, a time zone dial and an outer time dial. The movement mechanism has a shaft. The inner time dial has 24 equally divided labeled blocks configured for displaying a first time in a first time zone. The inner dial is coupled to the shaft so as to be driven by the movement mechanism. The time zone dial has 24 equally divided labeled blocks. The time zone dial is manually adjustably rotatable relative to the shaft. The outer time dial has 24 equally divided labeled blocks configured for displaying a second time in a second time zone. The outer time dial has a time zone pointer located at the location of 24 o'clock thereof configured for indicating the second time zone. The outer time dial is manually adjustably rotatable relative to the shaft.

In another aspect of the present invention, an alternative adjustable global timepiece is provided. The adjustable global timepiece includes a minute pointer, a hour pointer, a movement mechanism, an inner time dial, a time zone dial and an outer time dial. The movement mechanism has a shaft. The inner time dial has 12 equally divided labeled blocks configured for displaying a first time in a first time zone. The inner dial is coupled to the shaft so as to be driven by the movement mechanism. The time zone dial has 12 equally divided labeled blocks. The time zone dial is manually adjustably rotatable relative to the shaft. The outer time dial has 12 equally divided labeled blocks configured for displaying a second time in a second time zone. The outer time dial has a time zone pointer located at the location of 12 o'clock thereof configured for indicating the second time zone. The outer time dial is manually adjustably rotatable relative to the shaft.

The adjustable global timepiece may further includes a mounting base with the inner time dial, the time zone dial, and the outer time dial being mounted thereon. Correspondingly, the mounting base has 12 or 24 equipage first indentations, 12 or 24 resilient members and 12 or 24 beads. The resilient members and beads are received in the corresponding first indentations. The outer time dial has a lower surface with 12 or 24 equipage second indentations defined therein for partially receiving the beads. The second indentations spatially correspond to the 12 or 24 equally divided labeled blocks of the outer time dial and the first indentations.

The outer time dial may advantageously have a peripheral portion raised relative to the mounting base for facilitating manually rotation thereof. The time zone dial may include a knob configured for facilitating manually rotation thereof. Alternatively, the adjustable global timepiece may further includes a gear mechanism configured for facilitating manually rotation of the time zone dial. The gear mechanism includes a linkage shaft having a first end and an opposite second end, a gear arranged at the first end, and a wind knob arranged at the second end. The gear is meshed with the time zone dial.

Compared with conventional global timepiece, the present global timepiece has the following advantages. Firstly, the global timepiece may employ driving means of a traditional timepiece, e.g. a clockwork, a movement mechanism, and so on. By simply modification of the traditional timepiece to further provide a time zone dial and an outer time dial, the global timepiece can thus display time in two global time zones by adjusting the relative position of the time zone dial, the outer time dial, and the inner time dial. Secondly, the time zone dial and the outer time dial may be manually operated without the need for extra driving mechanisms.

The above and other features of the invention, including various novel details of construction and combination of parts, will now be more particularly described with reference to the accompanying drawings, in which:

DETAILED DESCRIPTION OF PREFERRED EMBODIMENTS

Reference will now be made to the drawings to describe the present invention in detail.

Figure 1:
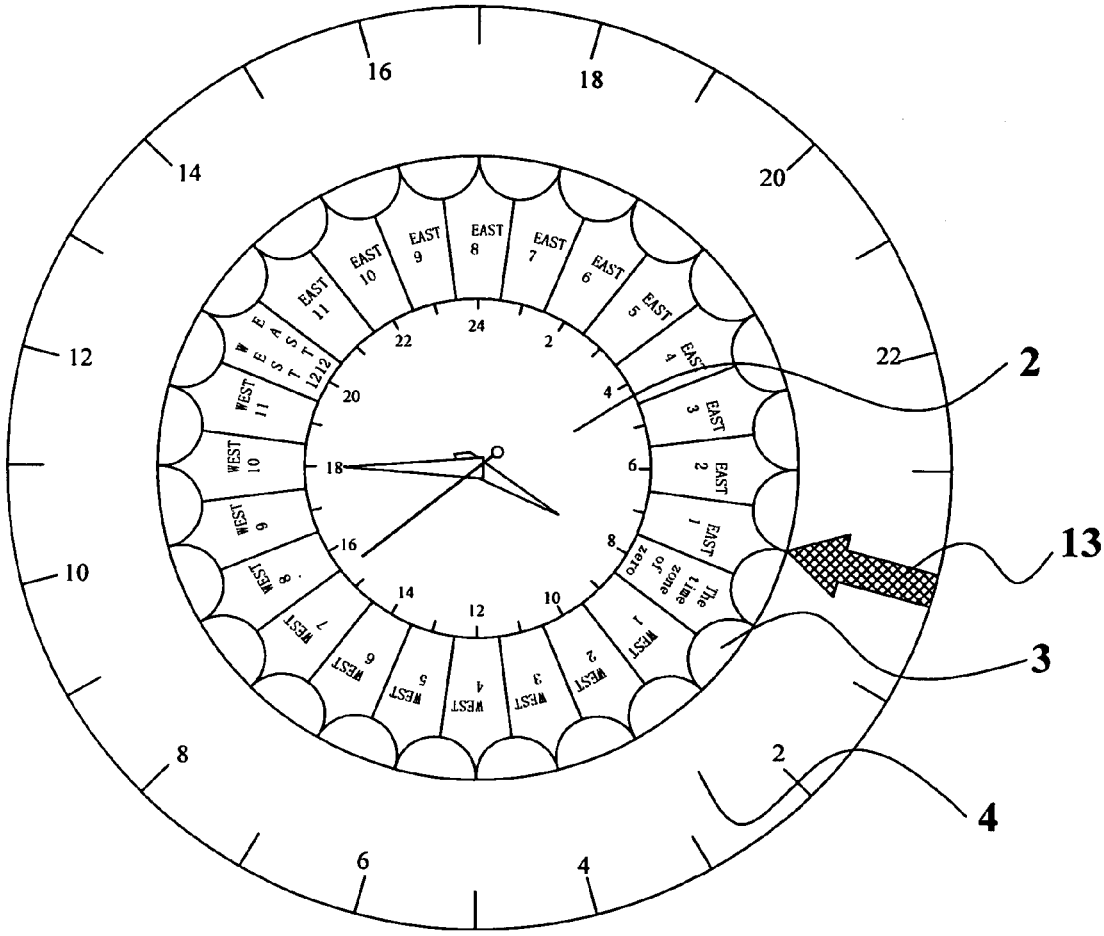
FIG. 1 is a schematic, top view of a global timepiece in accordance with a first preferred embodiment of the present invention.

Referring to FIG. 1, this shows an adjustable global timepiece in accordance with a first preferred embodiment. The adjustable global timepiece beneficially includes an inner time dial 2, a time zone dial 3 and an outer time dial 4. The inner time dial 2 has 24 equally divided labeled blocks configured for displaying a first time in a first time zone. In the present embodiment, the adjustable global timepiece further includes a movement mechanism, a second pointer, minute pointer, a hour pointer, each of which may be replaced with a conventional configuration of a tradition timepiece. The movement mechanism has a shaft. The inner time dial 2 is coupled to the shaft so as to be driven by the movement mechanism. The time zone dial 3 has 24 equally divided labeled blocks. The time zone dial 3 is configured to be manually adjustably rotatable relative to the shaft. The outer time dial 4 has 24 equally divided labeled blocks configured for displaying a second time in a second time zone. The outer time dial 4 has a time zone pointer 13 located at the location of 24 o'clock thereof configured for indicating the second time zone. The outer time dial 4 is configured to be manually adjustably rotatable relative to the shaft.

In the illustrate exemplary embodiment, the 24 equally divided labeled blocks of the inner time dial 2 and outer time dial 4 correspond to 1 though 24 o'clock of a whole day, respectively. The 24 equally divided labeled blocks of the outer time dial 4 correspond to the 24 time zones, i.e. ZERO time zone, WEST 1 though WEST 12 (EAST 12), and EAST 12 though EAST 1, in a clockwise order.

In use, firstly, the time pointers, the inner time dial 2 and the time zone dial 3 are set to indicate the time in the first time zone. As shown in FIG. 1, in the present embodiment, the first time zone is EAST 8, the time zone dial is therefore adjusted such that the block of the time zone dial 3 that is labeled with EAST 8 is set to the location of 24 o'clock of the inner time dial 2. In addition, the time in the EAST 8 time zone is 7:48:38, the time pointers are then set with respect to the inner time dial 2 to indicate 7:48:38. Secondly, the outer time dial 4 is adjusted such that the time zone pointer 13 thereof points at the block of the time zone dial 3 that shows the second time zone, e.g. EAST 1 time zone, in the illustrated embodiment. As a result, the time that is indicated by the time pointers with respect to the outer time dial 4 is the time in the second time zone, i.e. 0:45:38 in EAST 1 time zone.

Figure 2:
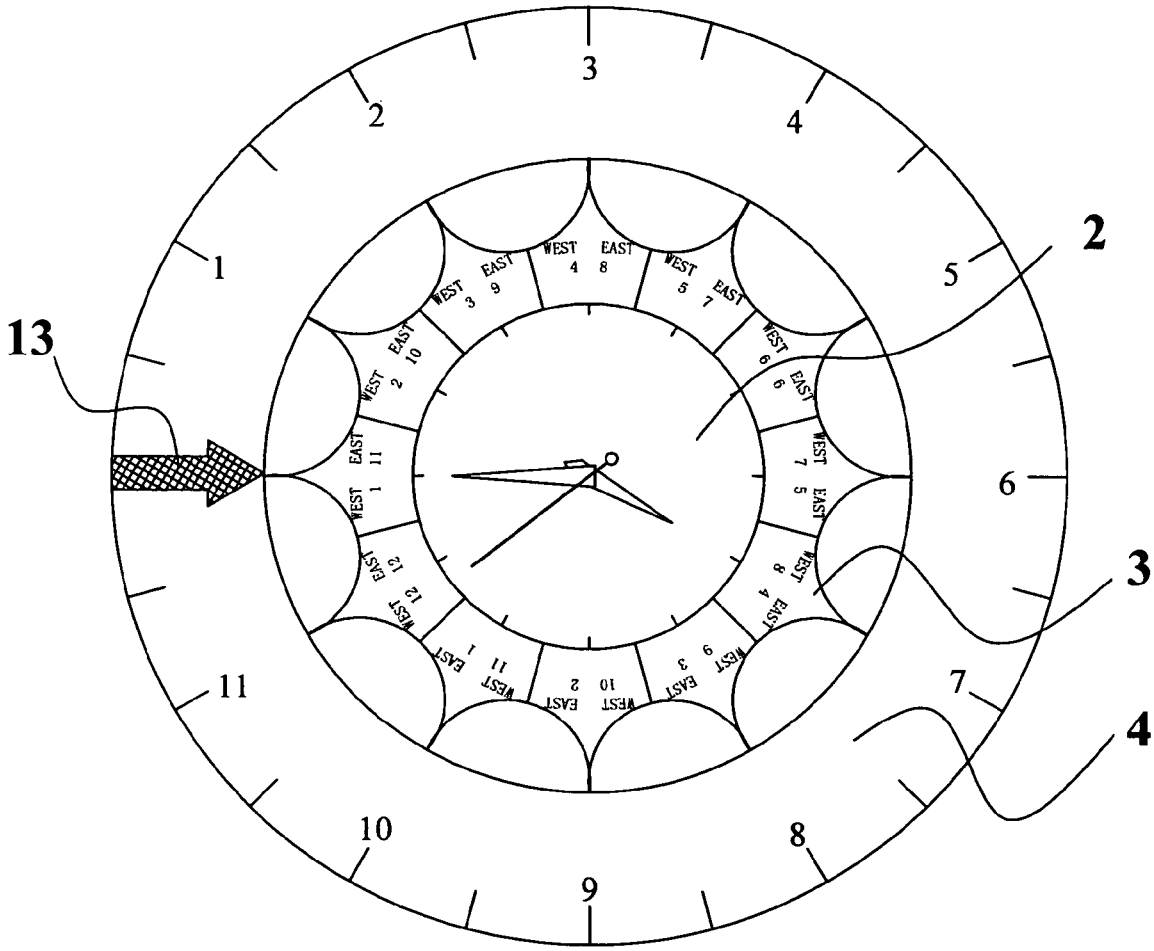
FIG. 2 is a schematic, top view of a global timepiece in accordance with a second preferred embodiment of the present invention.

Referring to FIG. 2, this shows an adjustable global timepiece in accordance with a second preferred embodiment. The adjustable global timepiece beneficially includes an inner time dial 2, a time zone dial 3 and an outer time dial 4. The inner time dial 2 has 12 equally divided labeled blocks configured for displaying a first time in a first time zone. In the present embodiment, the adjustable global timepiece further includes a movement mechanism, a second pointer, minute pointer, a hour pointer, each of which may be replaced with a conventional configuration of a tradition timepiece. The movement mechanism has a shaft. The inner time dial 2 is coupled to the shaft so as to be driven by the movement mechanism. The time zone dial 3 has 12 equally divided labeled blocks. The time zone dial 3 is configured to be manually adjustably rotatable relative to the shaft. The outer time dial 4 has 12 equally divided labeled blocks configured for displaying a second time in a second time zone. The outer time dial 4 has a time zone pointer 13 located at the location of 12 o'clock thereof configured for indicating the second time zone. The outer time dial 4 is configured to be manually adjustably rotatable relative to the shaft.

In the illustrate exemplary embodiment, the 12 equally divided labeled blocks of the inner time dial 2 and outer time dial 4 correspond to 1 though 12 o'clock of a half day, respectively. As is known, the time differences between EAST 1 and WEST 11, EAST 2 and WEST 10, EAST 3 and WEST 9, . . . EAST 12 and WEST 12, are all 12 hours. Therefore, the 12 equally divided blocks of the outer time dial 4 are labeled to indicate the foregoing 12 pairs of time zones, i.e. EAST 1 and WEST 11, EAST 2 and WEST 10, EAST 3 and WEST 9, . . . EAST 12 and WEST 12.

In use, firstly, the time pointers, the inner time dial 2 and the time zone dial 3 are set to indicate the time in the first time zone. As shown in FIG. 1, in the present embodiment, the first time zone is EAST 8, the time zone dial is therefore adjusted such that the block of the time zone dial 3 that is labeled with EAST 8 is set to the location of 12 o'clock of the inner time dial 2. In addition, the time in the EAST 8 time zone is 3:45:38, the time pointers are then set with respect to the inner time dial 2 to indicate 7:48:38. Secondly, the outer time dial 4 is adjusted such that the time zone pointer 13 thereof points at the block of the time zone dial 3 that shows the second time zone, e.g. EAST 11 time zone, in the illustrated embodiment. As a result, the time that is indicated by the time pointers with respect to the outer time dial 4 is the time in the second time zone, i.e. 6:45:38 in EAST 11 time zone. Understandably, due to the time difference between the EAST 11 and WEST 1 is 12 hours, the time in the WEST 1 time zone is thus 18:45:38.

Figure 3:
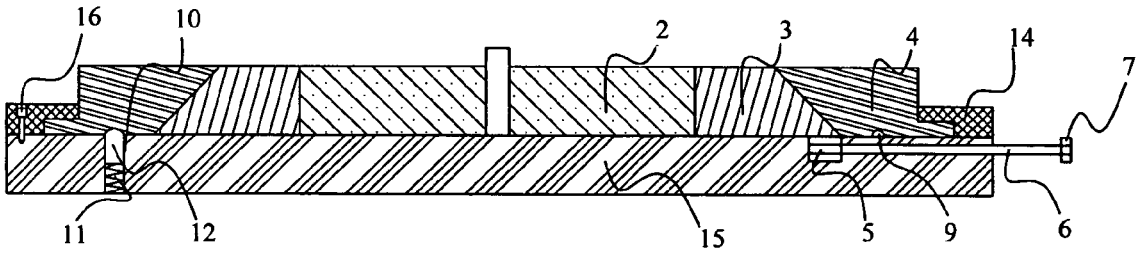
FIG. 3 is a schematic, cross-sectional view of a global timepiece in accordance with a third preferred embodiment of the present invention.

Referring to FIG. 3, this shows an adjustable global timepiece in accordance with a third preferred embodiment. The adjustable global timepiece beneficially includes a movement mechanism, an inner time dial 2, a time zone dial 3 and an outer time dial 4. The movement mechanism has a shaft. The inner time dial 2 is coupled to the shaft so as to be driven by the movement mechanism. The time zone dial 3 is configured to be manually adjustably rotatable relative to the shaft. In the illustrated exemplary embodiment, the time zone dial 3 is an annular dial concentrically surrounding the inner time dial 2 therein. The outer time dial 4 is configured to be manually adjustably rotatable relative to the shaft. Similarly, the outer time dial 4 is an annular dial concentrically surrounding the time zone dial 3 and the inner time dial 2 therein.

The adjustable global timepiece further includes a mounting base 15 with the inner time dial 2, the time zone dial 3, and the outer time dial 4 being mounted thereon. The outer time dial 4 has an engaging rim rotatable engaged with a mounting collar, which is, in turn, secured on the mounting base 15 using screws 16. The outer time dial 4 is mounted onto the mounting base 15 by securing the mounting collar to the mounting base 15. An interface between the outer time dial 4 and the time zone dial 3 is slanted so as to prevent the time zone dial 3 from detaching from the mounting base 15. In the case of the global timepiece of the first embodiment, the mounting base 15 may have 24 equipage first indentations 10, 24 resilient members 11, such as springs and 24 beads 12. The resilient members 11 and beads 12 are received in the corresponding first indentations 10. The outer time dial 4 has a lower surface with 24 equipage second indentations 9 defined therein for partially receiving the beads 12. The second indentations 9 spatially correspond to the 24 equally divided labeled blocks of the outer time dial 4 and the first indentations 10. The outer time dial 4 may advantageously have a peripheral portion raised relative to the mounting base 15 for facilitating manually rotation thereof. The adjustable global timepiece may further include a gear mechanism configured for facilitating manually rotation of the time zone dial 3. The gear mechanism includes a linkage shaft 6 having a first end and an opposite second end, a gear 5 arranged at the first end, and a wind knob 7 arranged at the second end. The gear 5 is meshed with a lower portion of the time zone dial 3. Thereby, the time zone dial 3 can be manually rotated by winding the wind knob 7.

Figure 4:
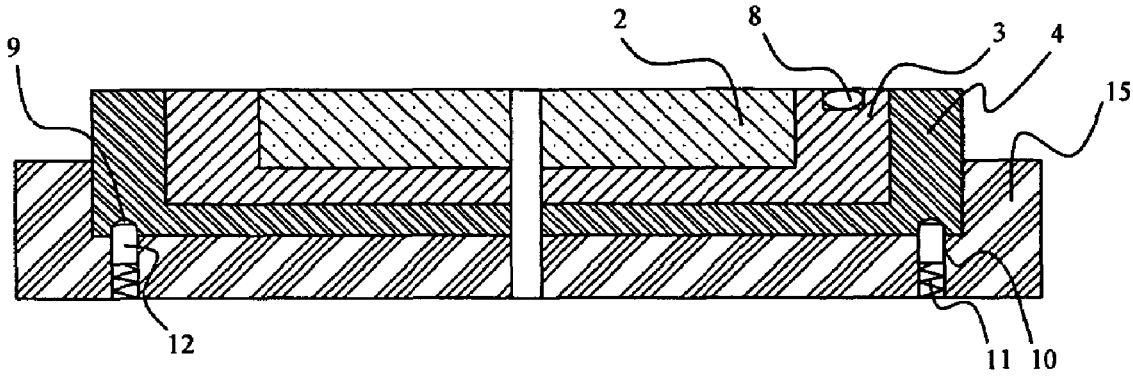
FIG. 4 is a schematic, cross-sectional view of a global timepiece in accordance with a fourth preferred embodiment of the present invention

Referring to FIG. 4, this shows an adjustable global timepiece in accordance with a fourth preferred embodiment. The adjustable global timepiece beneficially includes a movement mechanism, an inner time dial 2, a time zone dial and an outer time dial. The movement mechanism has a shaft. The inner time dial 2 is coupled to the shaft so as to be driven by the movement mechanism. The time zone dial is configured to be manually adjustably rotatable relative to the shaft. In the illustrated exemplary embodiment, the time zone dial is a circular plate having an annular dial region 3 concentrically surrounding the inner time dial 2 therein. The outer time dial is configured to be manually adjustably rotatable relative to the shaft. Similarly, the outer time dial is a circular dial having an annular dial region 4 concentrically surrounding the time zone dial region 3 and the inner time dial 2 therein.

The adjustable global timepiece further includes a mounting base with the inner time dial, the time zone dial, and the outer time dial being mounted thereon. In the case of the global timepiece of the second embodiment, the mounting base 15 may have 12 equipage first indentations 10, 24 resilient members 11, such as springs and 12 beads 12. The resilient members 11 and beads 12 are received in the corresponding first indentations 10. The outer time dial has a lower surface with 12 equipage second indentations 9 defined therein for partially receiving the beads 12. The second indentations 9 spatially correspond to the 12 equally divided labeled blocks of the outer time dial and the first indentations 10. The outer time dial 4 may advantageously have a peripheral portion raised relative to the mounting base 15 for facilitating manually rotation thereof. The time zone dial may further include a knob 8 configured for facilitating manually rotation thereof.

Although the present invention has been described with reference to a specific embodiment, it should be noted that the described embodiment is not necessarily exclusive and that various changes and modifications may be made to the described embodiment without departing from the scope of the invention as defined by the appended claims.

What is claimed is:

1. An adjustable global timepiece, comprises:

A timepiece body;

a primary dial mounted onto said timepiece body;

an hour pointer and a minute pointer rotatably mounted onto said primary dial for indicating a time;

a movement mechanism having a shaft coupled to said hour pointer and said minute pointer for driving said hour pointer and said minute pointer rotate with respect to said primary dial so as to indicate said time;

a first time zone ring having 24 equally divided markers, mounted onto said timepiece body, and being manually adjustably rotatable relative to said shaft for selectively rotating said first time zone ring to represent a predetermined first time zone; and a second time zone ring having 24 equally divided indicators concentrically mounted onto said timepiece body with respect to said first time zone ring; and a dual time indicating arrangement for manually and purposely dialing said second time zone ring with respect to said first time zone ring, wherein said dual time indicating arrangement has a guiding means provided at said timepiece body for selectively and circumferentially rotating said second time zone ring on said timepiece body, and a positioning engager provided at a bottom surface of said second time zone ring for rotatably and releaseably engaged with said guiding means for choosing a second time zone, such that a user is able to read said time at both said first time zone and said second time zone.

2. The adjustable global timepiece, as recited in claim 1, wherein said guiding means has 24 housings spacedly and circumferentially indented onto a top peripheral edge of said timepiece body, 24 resilient members accommodated with said housing, 24 biasing beads provided at an extending end of said resilient members for rotatably engaging with said positioning engager so as to secure said second time zone with respect to said primary dial.

3. The adjustable global timepiece, as recited in claim 2, wherein said positioning engager has at least two indentations provided at said bottom surface of said second time zone ring, such that whenever said second time zone ring is dialed by a user to rotate with respect to said primary dial, said two indentations are cable of subsequently engaging with said 24 resilient members in turn to selective position said second time zone ring at one of said second time zone.

4. The adjustable global time piece, as recited in claim 3, wherein said first time zone ring is wrapped around said primary dial, and said second time zone ring is sliably sleeved onto said first time zone ring, said second time zone ring has a slanted inner edge correspondingly mated with an outer edge of said first time zone ring so as to facilitate said second time zone ring smoothly sliding around said first time zone ring.

5. The adjustable global timepiece, as recited in claim 2, wherein said positioning engager has 24 indentations provided at said bottom surface of said second time zone ring, such that whenever said second time zone ring is dialed by a user to rotate with respect to said primary dial, said 24 indentations are capable of corresponding and subsequently engaging with said 24 resilient members so as to facilitate said second time zone ring smoothly rotatable with respect to said primary dial.

6. The adjustable global time piece, as recited in claim 5, wherein said first time zone ring is wrapped around said primary dial, and said second time zone ring is sliably sleeved onto said first time zone ring, said second time zone ring has a slanted inner edge correspondingly mated with an outer edge of said first time zone ring so as to facilitate said second time zone ring smoothly sliding around said first time zone ring.

7. The adjustable global time piece, as recited in claim 1, wherein said first time zone ring is wrapped around said primary dial, and said second time zone ring is sliably sleeved onto said first time zone ring, said second time zone ring has a slanted inner edge correspondingly mated with an outer edge of said first time zone ring so as to facilitate said second time zone ring smoothly sliding around said first time zone ring.

8. The adjustable global time piece, as recited in claim 2, wherein said first time zone ring is wrapped around said primary dial, and said second time zone ring is sliably sleeved onto said first time zone ring, said second time zone ring has a slanted inner edge correspondingly mated with an outer edge of said first time zone ring so as to facilitate said second time zone ring smoothly sliding around said first time zone ring.

9. An adjustable global timepiece, comprises:

a timepiece body having a bowlike cavity;

an outer time zone ring, having having 24 equally divided markers, rotatably received within said cavity;

an inner time zone ring, having 24 equally divided indicators, rotatably received within said cavity, wherein said inner time zone is coaxially and sliably engaged with an inner rim of said outer time zone;

a stationary dial coaxially mounted onto said timepiece body, wherein said stationary dial comprises an hour pointer and a minute pointer rotatably mounted onto said primary dial for indicating a time;

a movement mechanism having a shaft coupled to said hour pointer and said minute pointer for driving said hour pointer and said minute pointer rotate with respect to said primary dial so as to indicate said time; and a dual time indicating arrangement for manually and purposely dialing said second time zone ring with respect to said first time zone ring, wherein said dual time indicating arrangement has a guiding means provided at said timepiece body for selectively and circumferentially rotating said second time zone ring on said timepiece body, and a positioning engager provided at a bottom surface of said second time zone ring for rotatably and releaseably engaged with said guiding means for choosing a second time zone, such that a user is able to read said time at both said first time zone and said second time zone.

10. The adjustable global timepiece, as recited in claim 9, wherein said guiding means has 24 housings spacedly and circumferentially indented onto a top peripheral edge of said timepiece body, 24 resilient members accommodated with said housing, 24 biasing beads provided at an extending end of said resilient members for rotatably engaging with said positioning engager so as to secure said second time zone with respect to said primary dial.

11. The adjustable global timepiece, as recited in claim 10, wherein said positioning engager has at least two indentations provided at said bottom surface of said second time zone ring, such that whenever said second time zone ring is dialed by a user to rotate with respect to said primary dial, said two indentations are cable of subsequently engaging with said 24 resilient members in turn to selective position said second time zone ring at one of said second time zone.

12. The adjustable global timepiece, as recited in claim 11, wherein said inner time zone ring further comprises a rotating means provided at a peripheral edge of said inner time zone ring for facilitating said inner time zone ring rotate with respect to said timepiece body.

13. The adjustable global timepiece, as recited in claim 10, wherein said positioning engager has 24 indentations provided at said bottom surface of said second time zone ring, such that whenever said second time zone ring is dialed by a user to rotate with respect to said primary dial, said 24 indentations are capable of corresponding and subsequently engaging with said 24 resilient members so as to facilitate said second time zone ring smoothly rotatable with respect to said primary dial.

14. The adjustable global timepiece, as recited in claim 10, wherein said inner time zone ring further comprises a rotating means provided at a peripheral edge of said inner time zone ring for facilitating said inner time zone ring rotate with respect to said timepiece body.

15. The adjustable global timepiece, as recited in claim 9, wherein said inner time zone ring further comprises a rotating means provided at a peripheral edge of said inner time zone ring for facilitating said inner time zone ring rotate with respect to said timepiece body.

* * * * *